United States Patent [19]

Honjo et al.

[11] Patent Number: 4,878,656

[45] Date of Patent: Nov. 7, 1989

[54] SHEET FINISHER

[75] Inventors: Takeshi Honjo, Kawasaki; Akimaro Yoshida, Tokyo, both of Japan

[73] Assignee: Canon Kabushiki Kaisha, Tokyo, Japan

[21] Appl. No.: 171,484

[22] Filed: Mar. 21, 1988

[30] Foreign Application Priority Data

Mar. 20, 1987 [JP] Japan ..... 62-67487
Mar. 20, 1987 [JP] Japan ..... 62-67488
Mar. 20, 1987 [JP] Japan ..... 62-67489
Mar. 20, 1987 [JP] Japan ..... 62-67490

[51] Int. Cl.[4] ..... B42B 1/02
[52] U.S. Cl. ..... 270/53; 270/37
[58] Field of Search ..... 493/1, 2, 10, 14, 15, 493/25, 28, 29, 6, 320, 385, 460, 461; 270/37, 53, 58; 355/3 SH, 14 SH

[56] References Cited

U.S. PATENT DOCUMENTS 4,134,672 1/1979 Burlew ..... 355/3 SH
4,497,478 2/1985 Reschenhofer et al. ..... 270/53
4,717,134 1/1988 Iida et al. ..... 270/45
4,782,363 11/1988 Britt ..... 270/53
4,801,133 1/1989 Ishiguro ..... 270/53

*Primary Examiner*—Robert E. Garrett
*Assistant Examiner*—Therese M. Newholm
*Attorney, Agent, or Firm*—Fitzpatrick, Cella, Harper & Scinto

[57] ABSTRACT

A sheet finishing apparatus includes stacking device for receiving and stacking plural sheets sequentially discharged, stapling device for acting on a stack of the sheets stacked on the stacking device at a predetermined position of the stack to staple it, discharging device for discharging from the stacking device the sheets stapled by the stapling device, an inlet for allowing manual insertion of sheets to the stacking device, manually operable device for the stapling device, and automatic control device for actuating the stapling device when a preset number of the sheets are stacked on the stacking device, for actuating the discharging device when a stapling operation is completed, for actuating the stapling device in response to the manually operable device, and for not actuating the discharging device even when the stapling operation responsive to the manual device is completed.

21 Claims, 9 Drawing Sheets

SHEET FINISHER

FIELD OF THE INVENTION AND RELATED ART

The present invention relates to a sheet finisher usable with an image forming apparatus such as a copying machine, a printer and laser beam printer, which will hereinafter be called "copying apparatus" as a representative image forming apparatus, more particularly to a sheet finisher attached to a copying machine to receive sheets discharged from the copying machine, to stack and bind them.

A sheet finisher is known which receives and aligns the sheets discharged from the copying machine and then staples one corner of the sheets.

Also, a stapler is known which is not only effective to staple the sheets discharged from the copying machine but also to allow manual stapling for stapling a bundle of sheets other than those discharged from the copying machine. In such machines, easy handling and operation are further desired in view of an unexpert operator. The same applies to the case where during a continuing copying and stapling operation for a series of originals, another bundle of sheets is stapled.

Conventionally, a sheet stapling finisher moves laterally the sheet discharged on a sheet aligning tray by a movable member on the basis of a size data set by a sheet size setting means, and then staples the sheets.

In such a finishing apparatus, the lateral movement of the sheets is effected on the basis of the size data, and therefore, if the size of the sheets is not set by the sheet size setting means such as when the sheets are inserted by manual feeding, it is not possible to move the sheets in the lateral direction because the size of the sheets is not known by the apparatus.

Further, conventionally, a stapling finisher counts a number of sheets stacked on the sheet aligning tray by a counting means, and when the count reaches a predetermined, the sheets are stapled. If the count exceeds the staplable number, a warning is produced, and the stapling operation is not performed.

However, in the sheet finishing apparatus of this type, the counting means is used to count the number of sheets to be stapled, and therefore, when a bundle of the sheets is manually inserted into the stapler, the apparatus does not know the number of sheets. If the number of sheets is beyond the staplable number, the staple would be broken.

SUMMARY OF THE INVENTION

Accordingly, it is an object of the present invention to provide a sheet finisher apparatus by which a bundle of sheets is assuredly bound.

It is another object of the present invention to provide a sheet finisher by which a bundle of sheets can be automatically stapled, and in addition, a manually fed bundle of sheets can be stapled, and further, during a continuous copying operation, a manually fed bundle of sheets can be stapled by interrupting the continuous operation, and yet further, special sheets can be bundled, without problem.

In one aspect of the present invention, there is provided a sheet binding apparatus comprising an inlet for allowing a bundle of sheets to be manually inserted into a sheet aligning tray, means for starting a stapling operation to the bundle of sheets manually fed through the inlet, and control means for operating the stapler to staple the bundle of sheets which have been manually fed into the sheet aligning tray through the inlet and for keeping the sheet aligning tray supporting the stapled sheets after the stapling operation, although in the stapling operation for the sheets discharged from the image forming machine, the sheet stapled by the stapler is transported to an accommodating portion to allow the stapler to staple the next sheets.

According to this structure, when the sheets are manually fed through the inlet to the aligning tray, and then a starting signal is transmitted from the starting means to the control means, the manually fed sheets are stapled. After the stapling operation is performed, the operator is able to easily take the stapled sheets out through the inlet, since the sheets are continued to be placed on alignment tray.

While the sheets which are continuously discharged from the image forming apparatus used with the finishing apparatus, are stapled, the stapled bundle of sheets are removed from the stapling position to an accommodating portion immediately after the stapling, in order to allow the subsequent sheets to be stacked and stapled. However, the manually fed and stapled sheets are not accommodated in the accommodating portion but are retained on the sheet alignment tray, according to this aspect of the present invention, so that the manually fed sheets can be taken out of the apparatus, separately from the sheets discharged from the image forming apparatus. Also, when the sheets are stapled by interrupting the continuous operation, the sheets are not mixed with the other bundles of sheets. Also, when only one bundle of sheets is stapled, the bundle of sheets is easily taken out.

According to another aspect of the present invention, there is provided a sheet binding apparatus comprising a sheet aligning tray provided with sheet edge detecting means for detecting a lateral edge of a sheet, so that when the size data is not known by the apparatus, a movable member is moved by a driving means to laterally move the sheet until the sheet edge detecting means detects the sheet edge.

According to this structure, the sheet conveyed to the sheet aligning tray from an image forming apparatus or the like can be laterally aligned by the movable member with the stapling position on the basis of the size data if available; whereas when the sheet size data is not available as when the manually fed sheets are to be stapled, the sheets are laterally moved until the sheet edge detecting means detects the edge, and then the sheets are stapled. Accordingly, the manual stapling and interruption stapling can be performed without problem.

In a further aspect of the present invention, there is provided a sheet binding apparatus which is provided, in addition to counting means for counting the number of sheets stacked on a sheet aligning tray, with means for detecting a thickness of the sheets stacked on the sheet aligning tray. According to this aspect, when a bundle of sheets is inserted and stacked on the sheet aligning tray through the inlet, the thickness detecting means detects the thickness of the bundle of sheets. And on the basis of the detection, the discrimination is made as to whether the thickness exceeds the staplable thickness or not. If so, the stapler is disabled. If not, the stapler is actuated. Accordingly, the sheet stapling operation for the manually fed sheets can be performed stably without problem.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
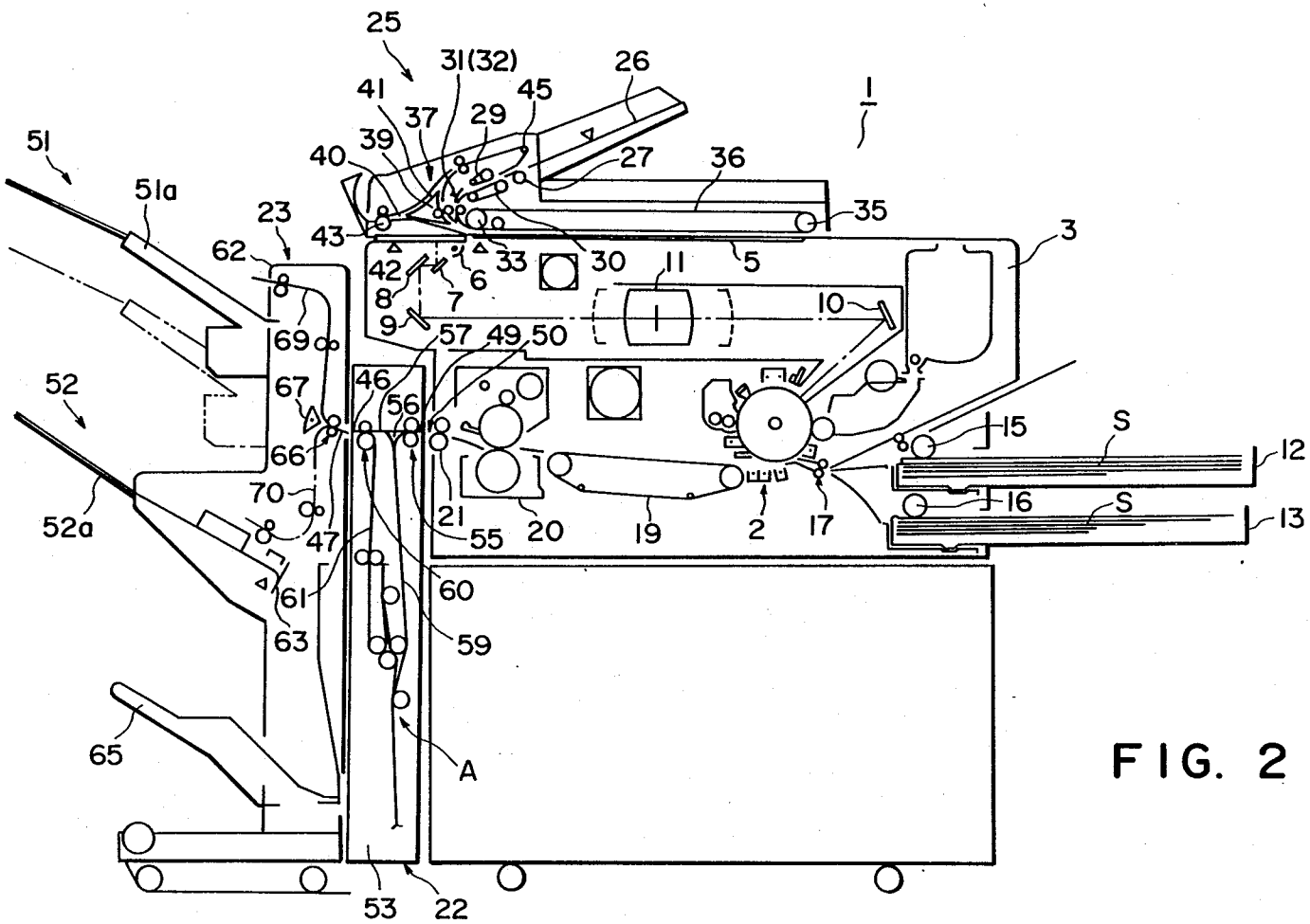
FIG. 2 is a sectional view of an image forming apparatus equipped with the sheet finisher apparatus of FIG. 1.

Referring first to FIG. 2, an image forming apparatus equipped with the sheet finisher according to an embodiment of the present invention will be described. A copying apparatus 1 which is an exemplary image forming apparatus comprises a main apparatus 3 containing therein a copying station 2. The main assembly 3 further includes a platen glass 5 for supporting an original to be copied, a light source 6 for illuminating an original to be copied, mirrors 7, 8, 9 and 10 for properly transmitting the light from the light source 6, a lens 11 for forming an image of the original placed on the platen glass 5, two cassettes 12 and 13 for accommodating copy sheets S. Above the cassettes 12 and 13, there are pick-up rollers 15 and 16, respectively. Downstream of the pick-up rollers 15 and 16 with respect to conveyance direction of the sheet S, a couple of registration rollers is provided, a further downstream of which, the copying station 2 is disposed. Further, downstream of the copying station 2, there are disposed a conveying belt 19 and a fixing apparatus 20. Downstream of the fixing apparatus 20, there is a couple of discharging rollers 21.

A sheet folding apparatus 22 and a finisher 23 are disposed adjacent to the main apparatus 3 of the copying machine 1, at a position downstream of the discharging roller couple 21.

The main assembly 3 is equipped with an automatic original or document feeder 25 at a top portion thereof. The original feeding apparatus 25 includes an original stacking tray 26 for stacking thereon originals M. In the neighborhood of the tray 26, a feeding roller 27 is mounted to feed the originals M from the tray 26. Downstream of the feeding roller 27 with respect to movement of the original, there are a separating belt 29 rotatable in the counterclockwise direction and a conveying belt 30 rotatable in the counterclockwise direction. Downstream of the belt 30, there are disposed sensors 31 and 32 for detecting a size of the original M, those sensors being arranged in a direction perpendicular to the conveyance of the original. Downstream of the sensors 31, 32, there is a conveying belt 36 trained around a driving roller 33 and a follower roller 35. In an original discharging portion 37 which is located at a left side of the belt 36, there is a flapper 39, around which conveying passages 40, 41 and 42 are disposed to which the original M is selectively guided by the flapper 39. The conveying passage 40 is provided with a reversing rollers 43, whereas the conveying passage 41 is provided with discharging rollers 45.

The folding apparatus 22 and the finisher apparatus 23 are so disposed that a sheet discharging outlet 46 of the folding apparatus 22 is in alignment with a sheet inlet 47 of the finisher apparatus 23 and that a sheet inlet 49 of the folding apparatus 22 is in alignment with a sheet discharging outlet 50 of the copying apparatus. The sheets S discharged from the copying machine 1 are folded into a predetermined shape by the folding apparatus 22, and then are stacked on a stacker 51 of the finisher 23 or to a stapling station 52 where they are stapled.

The folding apparatus 22 is provided with a couple of sheet receiving rollers at a position opposed to the sheet inlet 49 disposed at an upper right position of a main body 53 of the folding apparatus 22. Downstream of the receiving rollers 55, an inlet deflector 56 is disposed to selectively deflect the sheet S to two directions, whereby the sheet S coming from the sheet inlet 49 is transported selectively to a through path passage 57 or to a sheet holding passage 59. Adjacent a downstream end of the through path passage 57, there is a couple of discharging rollers 60, and downstream of the discharging rollers, a sheet discharging outlet 46 is formed. The sheet discharging outlet 46 is disposed at the same level with the sheet inlet 49. Downstream of the sheet holding passage 59, a sheet holding means A for two-folding or z-folding the sheet S. The folding means A is communicated with the through path passage 57 by a discharging passage 61.

The finisher apparatus 23 is equipped with a stacker tray **51*a* at an upper left portion of the main body 62 thereof, and is equipped with a stacker portion 51** which is reciprocally movable in the vertical direction by a driving means such as a motor.

Below the stacker portion 51, a stapling tray **52*a* of a stapler station 52 is disposed. To a bottom end of the stapling tray 52*a*, a stopper 63 is movably mounted to support an edge of a sheet S on the tray 52*a***.

An accommodating tray 65 is provided below the stapling station 52 to receive and accommodate a stapled bundle of sheets S on an accommodating tray 65 when the stapled sheets falls from the stapling tray **52*a* by movement of a stopper 63**.

Figure 1:
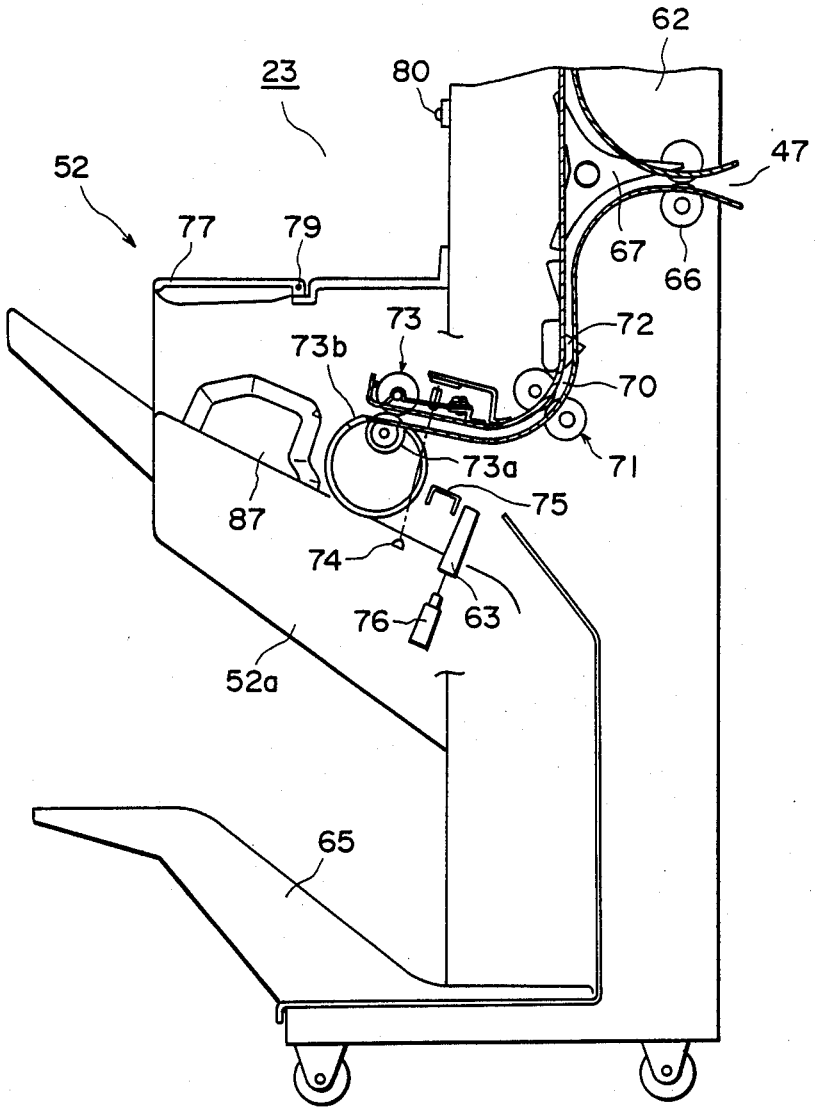
FIG. 1 is a sectional view of a sheet finisher apparatus according to an embodiment of the present invention.

At a front side of the main body 62 of the finisher 23, a sheet inlet opening 47 is formed as shown in FIG. 1. The sheet inlet 47 is disposed at the same level as the sheet discharging outlet of the copying machine 1 (FIG. 2). In the sheet inlet 47, a couple of sheet receiving rollers 66 is mounted. Downstream of the sheet receiving rollers 66, an inlet deflector 67 is mounted for selectively switching sheet feeding directions, so that the sheet S coming from the sheet inlet 47 is selectively deflected to a conveying passage 69 leading to a stacker portion or to a conveying passage 70 leading to the stapling station. The passage 70 is provided with a couple of conveying rollers 71 and a sensor 72. Downstream of the rollers 71, there are provided discharging rollers 73. A part of a belt **73*b*, which is in contact with the stapling tray 52*a* at its lower portion, is trained around a bottom roller 73*a* of the discharging roller couple 73. The belt 73*b*** rotates together with a bottom roller 73*a* to align with or abut to the stopper 63 the sheet S discharged onto the stapling tray 52*a*, thus aligning the sheet S in the longitudinal direction, more particularly, to align the trailing edge of the sheet S with respect to the discharging direction thereof to the stopper 63. The stopper 63 is connected with a solenoid so as to be retractable from a surface of the stacker tray 52*a* by an energizing operation of the solenoid 76. Above the stapling tray 52*a* adjacent a base end thereof, a stapler 75 is mounted to staple the sheets S stacked on the stapling tray 52*a*. The tray 52*a* is provided with a sensor 74 for detecting presence or absence of the sheet S(The stapling tray 52*a* is equipped with a protection cover 77. The cover 77 is rotatable about a hinge 79. A manual switch 80 is provided in the main body 62 of the apparatus above the cover 77. The switch 80 is effective to change the operation of the stapling station 52 from an automatic stapling mode to a manual stapling mode.

Figure 4:
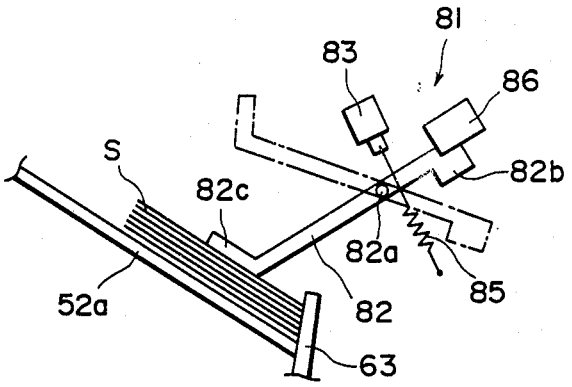
FIG. 4 is a front view of detecting means for detecting an amount of sheets stacked.

The stapling tray 52*a*, as shown in FIG. 4, is provided with a detecting means 81 for detecting an amount of the sheets S stacked thereon. The detecting means 81 includes a confining plate 82 swingably mounted by a shaft 82*a*, a solenoid 83 connected to the confining plate 82 to swing it, a spring 85 connected to the confining plate 82 adjacent an end opposite to that connected to the solenoid 83, a reflection type photosensor 86 which turns on and off in response to an end 82*b* of the confining plate 82 being faced thereto and in response to the end 82*b* away therefrom, respectively.

Figure 5A:
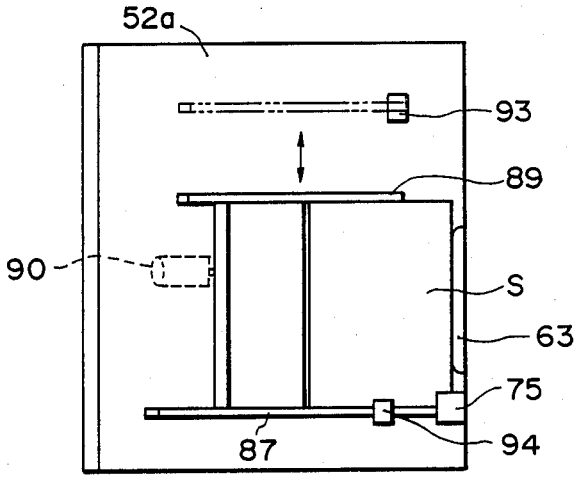
FIG. 5A is a top plan view of a sheet aligning tray.
Figure 5B:
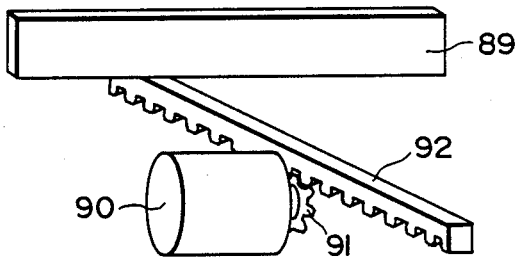
FIG. 5B is a perspective view illustrating a driving mechanism for a lateral shifting plate.

As shown in detail in FIG. 5A, the stapling tray 52*a* is provided with a fixed plate 87 upstanding therefrom at a front side of the tray 52*a* and is provided with a lateral shifting plate 89 at the rear side. The lateral shifting plate 89 is movable in the lateral direction by a stepping motor 90, a pinion 91 and a rack 92, as shown in FIG. 5B. At a further rear side of the stapling tray 52*a*, a home position sensor 93 is mounted to detect the lateral shifting plate 89 placed at its home position.

To the fixed plate 87, a sheet edge detecting device 94 is mounted to detect an edge of the sheet S.

Figure 5C:
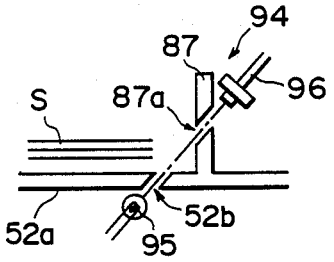
FIG. 5C is a side view of a sheet edge detecting means.

As shown in FIG. 5C, the detecting device 94 is provided with a hole 87*a* formed in the fixed plate 87, a hole 52*b*, a lamp 95 disposed in alignment with an extension of a line connecting the hole 52*b* and the hole 87*a* and a sheet edge sensor 96 which turns on when it receives the light from the lamp 95 and turns off when the light from the lamp 95 is blocked by the sheet S.

Figure 3:
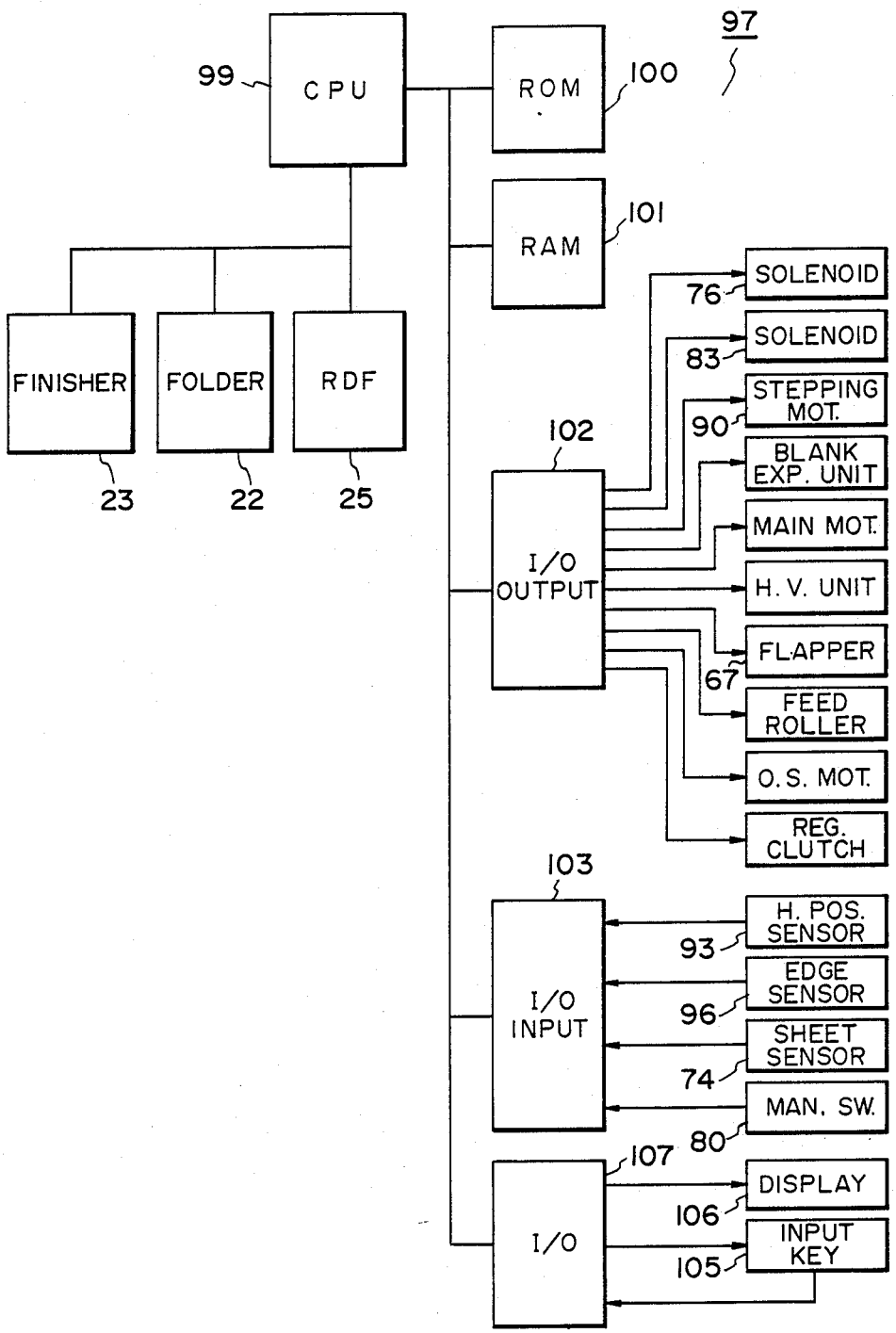
FIG. 3 is a block diagram illustrating control of the entire apparatus.

As shown in FIG. 3, the copying apparatus includes control means 97 which comprises a central processing unit (CPU) 99, a ROM 100 storing a controlling program for controlling the CPU 99, and a RAM 101 which is a main memory. The control means 97 is connected with an output interface 102 to transmit control signals to various loads such as main motor in the main apparatus 3 of the copying apparatus 1, with an input interface 103 for receiving detection signals from various sensors and with input-output interface 107 to receive operation signals from various inputting keys 105 and to produce displaying signals to various displays 106. Also, the control means 97 is connected with the finisher 23, the folding apparatus 22 and an automatic document feeder 25 and also with various sensor through interfaces.

Operation of the apparatus according to this embodiment will be described.

Figure 6B:
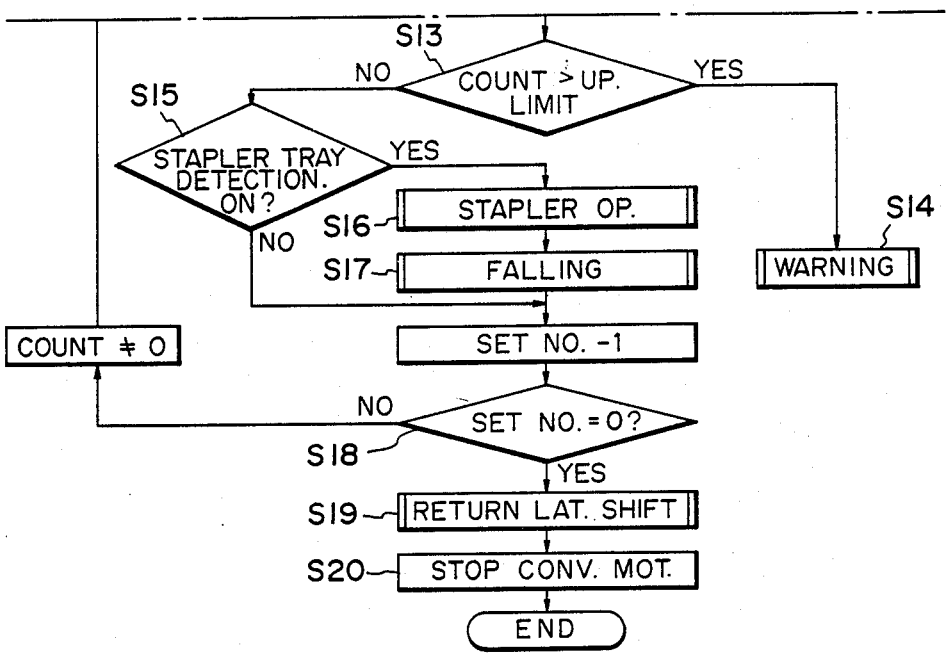
FIGS. 6A, 6B, and, 6–8 are flow charts illustrating operations of the apparatus according to this embodiment.
Figure 6:
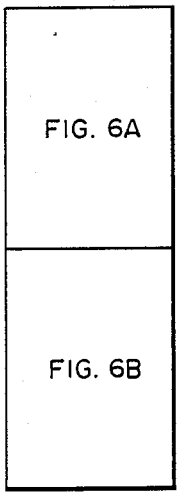
Figure 6A:
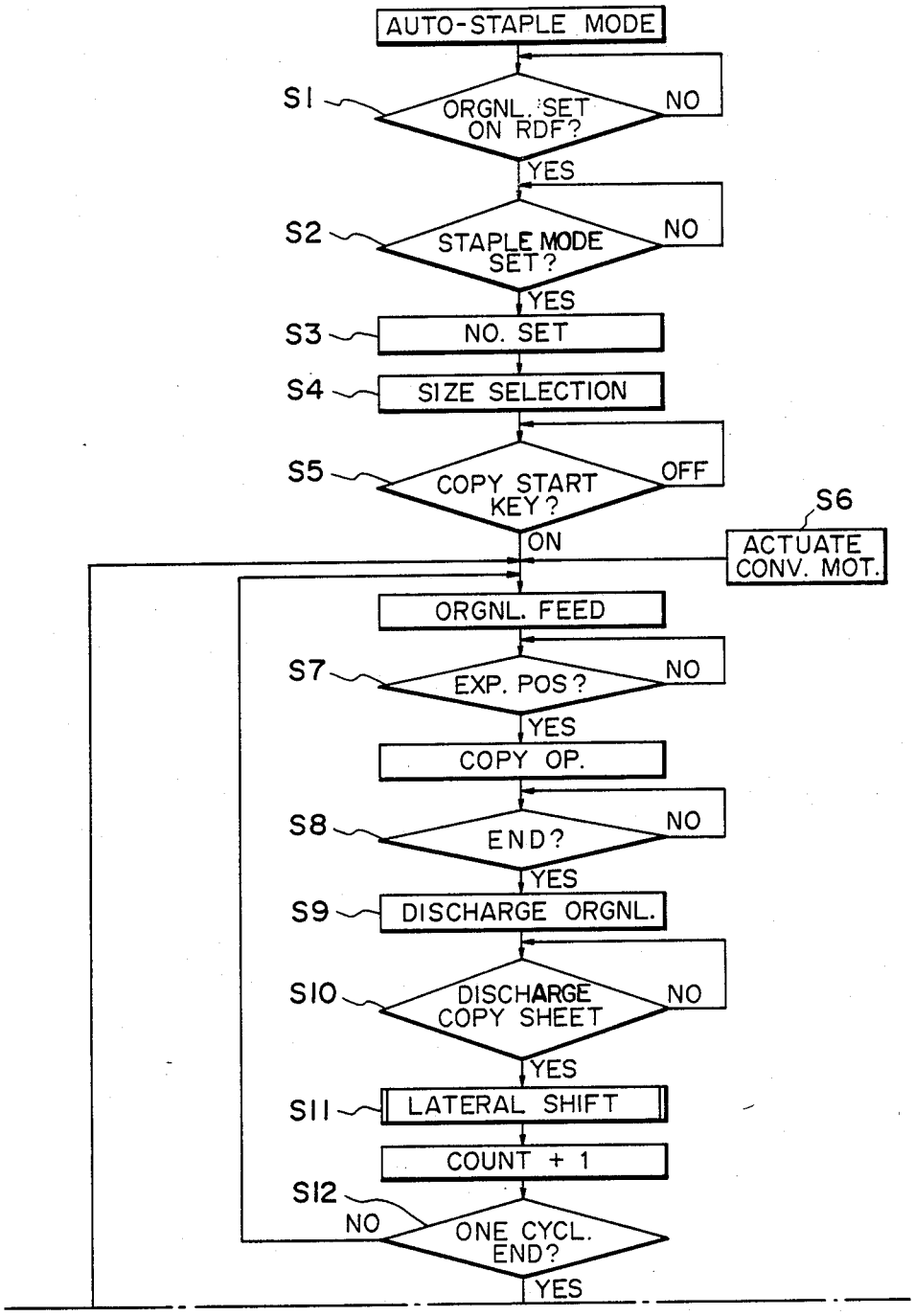

Referring to FIG. 6, the description will be first made has to the case where an automatic stapling mode is selected in the finisher 23. When an operator places original documents on the original tray 26 of the recirculation type document feeder 25, an unshown sensor for detecting presence or absence of the original detects the placed originals and transmits a signal to the CPU 99, which deems that the originals are set on the document feeder 25 (step S1), in response to the detection signal from the sensor. The operator selects an automatic stapling mode by an input key 105 (S2), sets a number of copies to be taken (S3) and selects a sheet size (S4). When the operator actuates an unshown copy start key (S5), an unshown conveying motor is operated (S6). By this, the feeding roller 27 starts to rotate to feed out the originals from the bottom one. The original is separated by the separating belt 29 and the conveying belt 30, so that the originals are fed to the conveying belt 36 one by one. The original is conveyed to an exposure position on the platen glass 5 by the conveying belt 36 (S7). Then, an image of the original is read by the light source 6, the mirrors 7, 8, 9 and 10 and the lens 11, so that a latent image is formed on the photosensitive drum of the copying station 2.

On the other hand, the sheet S is fed out of the cassette 12 or 13 by the pick up rollers 15 or 16, and is advanced to the photosensitive drum of the copying station 2 by the registration rollers 17 in timed relationship with the image on the photosensitive drum. The image is transferred onto the sheet S at the copying station 2, and the sheet is transported to the fixing device 20 through the conveying passage 19 (S8). During this, the original is conveyed back from the platen 5 to the conveying passage 40 by the conveying belt 36. When the trailing edge of the original passes by the flapper 39, the original is directed to the conveying passage 41, and is discharged back to the original tray 26 by the discharging rollers 45 (S9).

On the other hand, the sheet S is processed by the fixing device 20, by which the transferred image is fixed, and then is discharged through the discharging outlet 50 by the discharging couple of rollers 21. The sheet S thus discharged is received by the folding apparatus 22 through the sheet inlet 49 and is advanced by the rotation of the inlet rollers 55 to the inlet deflector 56. When a through path mode is selected for the folding apparatus 22, the deflector 56 guides the sheet S to the through path passage 57, by which the sheet is discharged by the discharging rollers 60 through the conveying passage 57 and through the sheet discharger outlet 46. When the folding mode is selected in the folding apparatus 22, the inlet deflector 56 directs the sheet S to the sheet folding passage 59 to convey the sheet to the folding means A through the conveying passage 59. The sheet S is two folded or z-folded by the folding means A, and then is conveyed to the sheet conveying passage 61 and further to a discharging roller couple 60, which discharge the sheet through the sheet outlet 46. The sheet S discharged through the sheet discharge outlet 46 of the folding apparatus 22 is introduced into the sheet inlet 47 of the finisher apparatus 23 to the inlet roller couple 66. The sheet S is directed by the flapper 67 to the conveying passage 70, and further is discharged to the discharging roller couple 73 by the conveying roller couple 71.

During this, the sheet S is detected by the sensor 72, and the detection is transmitted to the control means 97, in response to which the control means 97 counts the number of sheets S.

The sheet S is discharged onto the stapling tray 52*a* by the discharging roller couple 73, and then is abutted to the stopper 63 by the urging action of the belt 73*b* in the longitudinal direction (leading-trailing direction) (step S10).

Further, the sheet S is urged to be brought into contact with the fixed plate 87 by the lateral shifting plate 89 so that it is aligned in the lateral direction (S11).

Figure 7A:
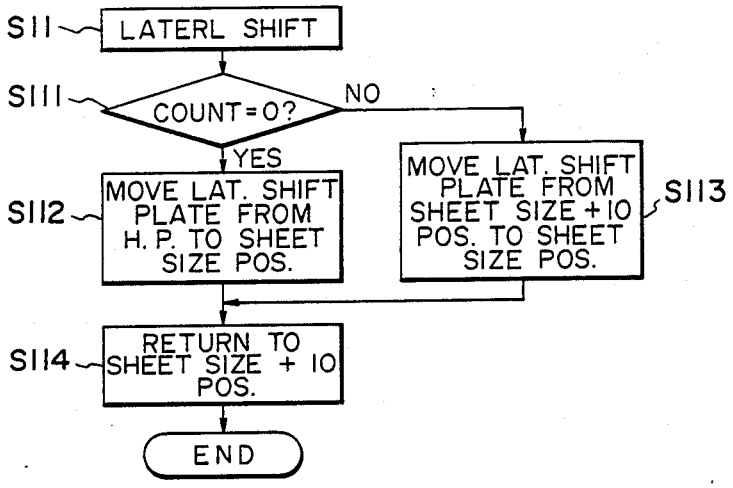

As shown in FIG. 7A, when the first copied sheet S is discharged onto the stapling tray 52*a*, the count stored in the CPU 99 of the control means 97 effective to count the number of sheets S on the basis of the detection signal of the sensor 72 is zero (S111). On the basis of the count, the CPU 99 moves the lateral shifting plate 89 from the home position to the sheet size position, so that the first sheet S is abutted to the fixed plate 87 to align the sheet in the lateral direction by controlling the stepping motor 90 (S112). The detection signal of the sensor 72 having detected by the passage of the first sheet S is transmitted to the CPU 99 through the interface 103, by which the count in the CPU 99 is renewed to 1, in response to which the CPU 99 causes the lateral shifting plate 89 to be moved away from the sheet side position by 10 mm (S114). Further, when the count is not zero at the step S101, that is, the second and subsequent sheets S, are laterally aligned by the movement of the lateral shifting plate 89 from the 10 mm away position to the sheet size position each time the copy sheet S is discharged (S113).

Figure 7B:
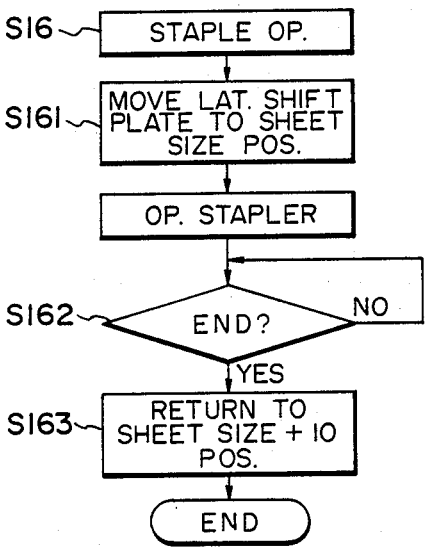

In this manner, the counter in the CPU 99 is incremented one by one, and the operation from the step S1 to the step 11 is repeated until all the originals stacked on the tray 26 of the document feeder 25 are copied through one circulation (S12). Subsequently, that is, when a bundle of copy sheets are discharged from a bundle of the originals, the CPU 99 compares the count with the capable number of the stapler 75 (S13). If the count exceeds the staplable number of the stapler 75, a warning is produced on the display 106 (S14). If it does not exeeed the capability, the CPU 99 confirms the existence of the bundle of sheets S on the stapling tray by the sensor 74, and then actuates the stapler 75 (S16). In the stapling operation, as shown in FIG. 7B, the lateral shifting plate 89 is moved to the sheet size position prior to the stapling operation to limit movement of the sheets by the lateral shifting plate 89 and the fixing plate 87 between them (S161).

Figure 7C:
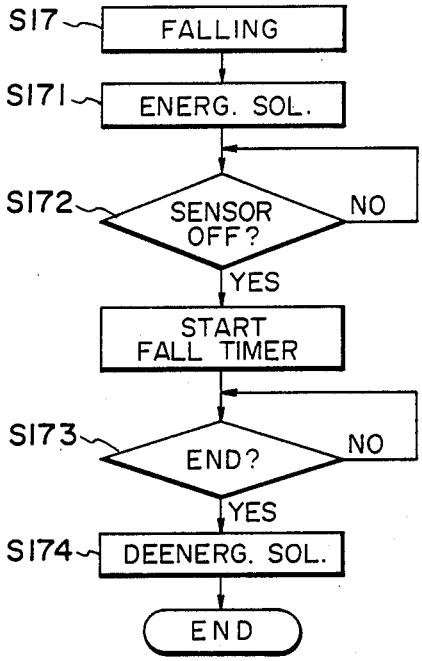

Subsequently, the stapler 75 is actuated to staple the sheets S. After completion of the stapling action (S162), the lateral shifting plate 89 is moved from the sheet size position by 10 mm (S163). Thereafter, the stapled bundle of sheets S is allowed to fall into the accommodating tray 65 (S17). The allowing action, as shown in FIG. 7C, is controlled by the CPU 99, which energizes the solenoid 76 to retract the stopper 63 from the top surface of the stapling tray 52*a* (S171). By the retraction, the bundle of sheets S is moved on the stapling tray 52*a* surface by the belt 73*b* which resumes its operation. At this time, the trailing edge of the bundle S is detected by the sensor 74, in response to which the sensor 74 is turned off (S172), upon which the CPU 99 starts an unshown timer in the CPU 99. After the timer interval which is set to be matched with the time required by the bundle of sheets S passing through the stopper 63, it stops (S173), upon which the solenoid 76 is deenergized to return the stopper 63 to the home position projecting the out of the surface (S174). In addition, the turning off for the sensor 74 is transmitted to the CPU 99 to allow the next stapling operation.

The CPU 99 repeats the operation from the step S7 to the step S17, and reduces the number set in the counter at the step S3. The counter reaching zero, means completion of the set number of copy sheets (S18). Then, the CPU 99 causes the lateral shifting plate 89 (S19).

Figure 7D:
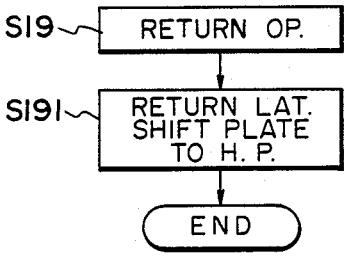

As shown in FIG. 7D, when the lateral shifting plate 89 is returned to the home position (S191), and the lateral shifting plate 89 is detected by the home position sensor 93, the detection signal is transmitted to the CPU 99 through the interface 103. In response to the detection signal, the CPU 99 stops an unshown driving motor of the finisher 23 to complete the entire operation (S20).

Figure 8:
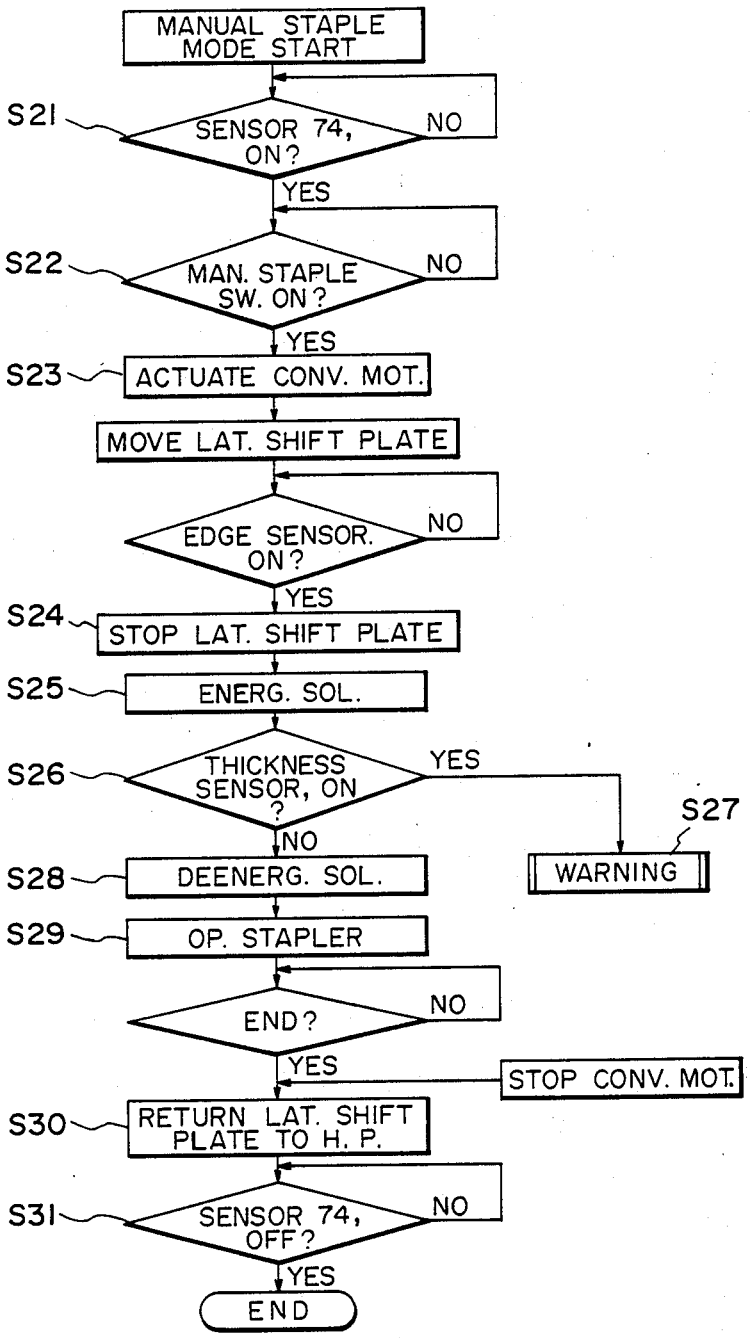

Referring to FIG. 8, the description will be made with respect to the case of manual stapling mode being set in the finisher 23. The operator opens the cover 77 and inserts manually the bundle of sheets S onto the stapling tray 52*a*. Then, the sensor 74 is turned on by detecting the sheets S (step S21). Then, the operator actuates the manual switch 80 (S22), which is detected by the CPU 99 through the interface 103, and the CPU 99 executes the manual stapling mode program stored in the ROM 100. The CPU 99 actuates a conveying motor not shown to rotate the belt 73*b* (S23). Then, the bundle of sheets S manually placed on the stapling tray 52*a* is abutted to a stopper 63 by the belt 73*b* so as to be aligned in the longitudinal direction. Further, the CPU 99 drives the stepping motor 90 to advance the lateral shifting plate 89 toward the fixed plate 87, and when the sheet edge sensor 96 detects the edge of the bundle of sheets, the stepping motor 90 is stopped to stop the movement of the lateral shifting plate 89 (S24). The CPU 99, then, energize the solenoid 83 of the stack amount detecting means 81 (S25) to swing the confining plate 82 to abut an end 82*c* of the confining plate to the bundle of sheets S. If the sensor 86 is turned off as a result of the other end 82*b* of the confining plate 82 being removed from the thickness sensor 86, the CPU 99 receiving the off-signal from the sensor 86 deems that the thickness of the bundle of the sheets S is beyond the stapling power of the stapler 75, and produces a warning on the display 106 (S27). When, on the other hand, the end 82*b* of the confining plate 82 is overlaid on the thickness sensor 86 to turn on the sensor 86, the CPU 99 receiving the on-signal from the sensor 86 deems that the thickness of the bundle of the sheets are within the stapling power of the stapler 75 and deenergize the solenoid 83 (S28). The CPU 99 actuates the stapler 75 to staple the sheets S (S29). The CPU 99, upon completion of the stapling operation, stops the conveying motor to stop rotation of the belt 73*b*, and actuates the stepping motor 90 to return the lateral shifting plate 89 to its home position (S30). In this manual mode, the stopper 63 is not retracted even after the stapling operation ends. Then, the operator opens the cover 77 of the stapling tray 52*a* and takes the bundle of sheets which have been stapled out of the stapling tray 52*a*. By this, the sensor 74 is turned off (S31), and the operation in the manual stapling mode ends.

After the stapling action is performed in this embodiment, the bundle of the sheets S is maintained on the stapling tray 52*a* with the edge abutting the stopper 63, while being sandwiched between the belt 73*b* and the tray 52*a*. However, it is a possible alternative that the belt 73*b* is reversed to convey the bundle of sheets S toward the free end sides of the stapling tray 52*a* by such an amount that the free end portion of the bundle of sheets S is sufficiently away from the belt 73*b*, by which the stapled sheets are more easily taken out.

The operativeness will be further improved by displaying completion of the manual stapling action on the display 106.

In this embodiment, when only one set of sheets is to be stapled, the CPU 99 controls the stopper 63 so that it is not retracted, so as to facilitate the operation.

In the foregoing embodiment, the stack amount detecting means 81 detects the thickness of the bundle of sheets only in the manual stapling mode, but this is not limiting, and the thickness of the stack of the sheets is detected also in the automatic stapling mode. By this, when thick sheets are used, the thickness and the stapling power can be compared so that a further stabilized stapling operation can be achieved. Further, when the sheets S are folded by the folding apparatus 22, the stapling operation is further stabilized.

In the foregoing embodiment, the sheet edge detecting means 94 is provided only on the fixed plate 87, but this is not limiting, and an additional sheet edge detecting means is provided on the lateral shifting plate 89. If this is done, the lateral shifting plate 89 can be advanced until both of the detecting devices detect edges of the sheets S, by which the lateral shifting operation is further assured.

The description will be made as to an interrupting operation. Here, the interrupting operation means that when an urgent need arises for production of one or more copies during a time consuming operation being carried out such as a number of copy sets to be produced from a number of originals, the time consuming operation is once stopped at convenient timing, and the urgent copy or copies are taken. According to this embodiment, the operator in such a case depresses an interruption key, by which the control of the stopper 63 is disabled. Therefore, after the copy sheet are aligned and stapled by the stapler 75, the stopper 63 is not retracted, by which the interrupting copy or copies are retained on the stapling tray 52*a*. Therefore, the interrupting copies are not mixed with the stapled copies on the stacker 65.

After the interrupting copies are taken, that is, after the bundle of sheets is taken out of the tray 52*a*, the interrupted copy operation is resumed by depressing the copy button.

The description will be made as to a further controlling system for the stapler in this embodiment.

The apparatus of this embodiment further includes sheet detecting means 74 for detecting presence or absence of the sheet on the sheet aligning tray 52*a*. The CPU 99 permits the stapling operation 75 when it receives from the sheet detecting means 74 a signal indicative of the presence of the sheet after the counting means 72 counts up the preset number of sheets; and the CPU 99 prohibits operation of the stapler 75 after the completion of the stapling operation until the sheet detecting means 74 transmits to the CPU a signal indicative of the absence of the sheet.

With this structure, the sheets conveyed to the sheet aligning tray from the image forming apparatus are counted by the counting means 72, and when the count reaches a predetermined, the CPU 99 confirms the presence of the sheet by the sheet detecting means 74. Only then, the sheets are stapled by the stapler 75. When the sheet detecting means 74 detects the absence of the sheet on the sheet aligning tray 52*a* after the stapled sheets are conveyed to the accommodating means 65, the CPU 95 prohibits the operation of the stapler 75.

According to this feature, the presence of the sheet can be detected by the sheet detecting means prior to the stapling operation, and therefore, the stapler is prevented from carrying out the stapling operation without the sheets to be stapled, and after the stapling operation, the stapling operation is prohibited until the sheet detecting means detects the absence of the sheets, but enables the stapling operation thereafter, so that the double stapling can be prevented.

While the invention has been described with reference to the structures disclosed herein, it is not confined to the details set forth and this application is intended to cover such modifications or changes as may come within the purposes of the improvements or the scope of the following claims.

What is claimed is:

1. A sheet finishing apparatus, comprising:

stacking means for receiving and stacking plural sheets sequentially discharged;

stapling means for acting on a stack of the sheets stacked on said stacking means at a predetermined position of the stack to staple it;

discharging means for discharging from said stacking means the sheets stapled by said stapling means;

an inlet for allowing manual insertion of sheets to said stacking means;

manually operable means for said stapling means; and automatic control means for actuating said stapling means when a preset number of the sheets are stacked on said stacking means, for actuating said discharging means when a stapling operation is completed, for actuating said stapling means in response to said manually operable means, and for not actuating said discharging means even when the stapling operation responsive to said manual means is completed.

2. An apparatus according to claim 1, wherein said discharging means including a stopper which retracts from its stopping position to permit the stapled sheets to discharge upon completion of the stapling operation.

3. An apparatus according to claim 2, wherein said discharging means includes a member for urging the sheets.

4. An apparatus according to claim 3, further comprising accommodating means for accommodating the stapled sheets discharged by said discharging means, said accommodating means being disposed below said stacking means.

5. An apparatus according to claim 2, further comprising a sensor for detecting whether sheets are stacked on said stacking means, and alignment means for acting on the sheets to abut edges of the sheets to a stopper before stapling when the manually operable means is actuated with the sensor detecting the sheets.

6. A sheet finishing apparatus, comprising:

stacking means for receiving and stacking plural sheets sequentially discharged;

stacking means for acting on a stack of the sheets stacked on said stacking means at a predetermined position of the stack to staple it;

discharging means for discharging from said stacking means the sheets stapled by said stapling means; and control means for actuating said stapling means when a preset number of the sheets are stacked on said stacking means, for selectively actuating and not actuating said discharging means when a stapling operation is completed.

7. An apparatus according to claim 6, further comprising means for instructing a number of stapled bundle of sheets, and said discharging means is prevented from operation when only one stapled bundle of sheets is to be produced.

8. An apparatus according to claim 6, further comprising means for selecting the number of stapled bundle of sheets to be produced, and means for preventing said discharging means from operating when at least one stapled bundle of sheets is to be produced by an interrupting operation.

9. A sheet finishing apparatus, comprising:
stacking means for receiving and stacking plural sheets sequentially discharged;
lateral shifting means movable to urge the sheets on said stacking means to align them with a reference position;
stapling means for acting on a stack of the sheets stacked on said stacking means at a predetermined position of the stack to staple it;
an inlet for allowing manual insertion of sheets to said stacking means;
manually operable means for said stapling means;
detecting means for detecting edges of the sheets on said stacking means;
control means for controlling said lateral shifting means to move it in accordance with information of a size of the sheets, and for controlling said lateral shifting means to move it until said detecting means detects the edge.

10. An apparatus according to claim 9, further comprising a fixed stopper at the reference position.

11. An apparatus according to claim 10, wherein said detecting means is so disposed that it detects the edge of the sheet when it abuts the fixed stopper.

12. An apparatus according to claim 11, wherein said detecting means includes a photointerruptor wherein light is blocked by the edge of the sheet when it abuts the fixed stopper.

13. A sheet finishing apparatus, comprising:
stacking means for receiving and stacking plural sheets sequentially discharged;
stapling means for acting on a stack of the sheets stacked on said stacking means at a predetermined position of the stack to staple it;
an inlet for allowing manual insertion of sheets to said stacking means;
manually operable means for said stapling means;
detecting means for detecting a thickness of the stack of the sheets stacked on said stacking means; and
control means for controlling said stapling means to prevent operation thereof in accordance with information of a number of sheets stacked on said stacking means, and to prevent operation thereof in accordance with information of thickness of the stack of the sheets on said stacking means.

14. An apparatus according to claim 13, further comprising a counter for counting a number of the sheets.

15. An apparatus according to claim 13, wherein said detecting means includes an actuator portion movable in accordance with thickness of the stack of the sheets on said stacking means and a switch portion for detecting amount of movement of the actuator portion.

16. A sheet finishing apparatus, comprising:
stacking means for receiving and stacking plural sheets sequentially discharged;
stapling means for acting on a stack of the sheets stacked on said stacking means at a predetermined position of the stack to staple it;
detecting means for detecting presence or absence of the sheets on said stacking means; and
control means for controlling said stapling means to actuate it when said control means receives both information that a preset number of the sheets are stacked on said stacking means and that the sheets are present on said stacking means, and for controlling said stapling means to prevent operation thereof after said stapling means is once operated, until said detecting means detects absence of the sheet.

17. An apparatus according to claim 16, further comprising an inlet for allowing manual insertion of sheets to said stacking means and manually operable means associated with said stapling means.

18. A sheet finishing apparatus, comprising:
stacking means for receiving and stacking plural sheets sequentially discharged;
stapling means for acting on a stack of the sheets stacked on said stacking means at a predetermined position of the stack to staple it;
discharging means for discharging from said stacking means the sheets stapled by said stapling means;
an inlet for allowing manual insertion of sheets to said stacking means;
manually operable means for said stapling means; and
automatic control means for actuating said stapling means when a preset number of the sheets are stacked on said stacking means, for actuating said discharging means when a stapling operation is completed, for actuating said stapling means in response to said manually operable means, and for not actuating said discharging means even when the stapling operation responsive to said manual means is completed;
stack thickness detecting means for detecting a thickness of the stack of the sheets stacked on said stacking means;
first control means for controlling said stapling means to prevent operation thereof in accordance with information of a number of sheets stacked on said stacking means, and to prevent operation thereof in accordance with information of thickness of the stack of sheets on said stacking means;
lateral shifting means movable to urge the sheets on said stacking means to align them with a reference position;
sheet edge detecting means for detecting edges of the sheets on said stacking means;
second control means for controlling said lateral shifting means to move it in accordance with information of a size of the sheets, and for controlling said lateral shifting means to move it until said detecting means detects the edge.

19. A sheet finishing apparatus, comprising:
stacking means for receiving and stacking plural sheets sequentially discharged;
stapling means for acting on a stack of the sheets stacked on said stacking means at a predetermined position of the stack to staple it;
discharging means for discharging from said stacking means the sheets stapled by said stapling means;
an inlet for allowing manual insertion of sheets to said stacking means;
manually operable means for said stapling means; and automatic control means for actuating said stapling means when a preset number of the sheets are stacked on said stacking means, for actuating said discharging means when a stapling operation is completed, for actuating said stapling means in response to said manually operable means, and for not actuating said discharging means even when the stapling operation responsive to said manual means is completed;

stack thickness detecting means for detecting a thickness of the stack of the sheets stacked on said stacking means;

first control means for controlling said stapling means to prevent operation thereof in accordance with information of a number of sheets stacked on said stacking means, and to prevent operation thereof in accordance with information of thickness of the stack of sheets on said stacking means;

lateral shifting means movable to urge the sheets on said stacking means to align them with a reference position;

sheet edge detecting means for detecting edges of the sheets on said stacking means;

second control means for controlling said lateral shifting means to move it in accordance with information of a size of the sheets, and for controlling said lateral shifting means to move it until said detecting means detects the edge;

sheet detecting means for detecting presence or absence of the sheets on said stacking means; and third control means for controlling said stapling means to actuate it when said control means receives both information that a preset number of the sheets are stacked on said stacking means and that the sheets are present on said stacking means; and for controlling said stapling means to prevent operation thereof after said stapling means is once operated, until said detecting means detects absence of the sheet.

20. An image forming apparatus comprising:

sheet feeding means for feeding sheets;

image forming means for forming images on the sheets fed by said sheet feeding means;

a sheet guiding passage for guiding the sheets through said image forming means from an upstream side of said image forming means to a downstream side thereof;

means for applying an image formation signal to said image forming means;

stacking means for receiving and stacking plural sheets sequentially discharged;

stapling means for stapling a stack of sheets stacked on said stacking means at a predetermined positions;

discharging means for discharging from said stacking means the sheets stapled by said stapling means;

an inlet for allowing manual insertion of sheets to said stacking means;

manually operable means for said stapling means; and automatic control means for actuating said stapling means when a preset number of the sheets are stacked on said stacking means, for actuating said discharging means when a stapling operation is completed, for actuating said stapling means in response to said manually operable means, and for not actuating said discharging means even when the stapling operation responsive to said manual means is completed.

21. An image forming apparatus, comprising:

sheet feeding means for feeding sheets;

image forming means for forming images on the sheets fed by said sheet feeding means;

a sheet guiding passage for guiding the sheets through said image forming means from an upstream side of said image forming means to a downstream side thereof;

means for applying an image formation signal to said image forming means;

stacking means for receiving and stacking plural sheets sequentially discharged from said image forming means;

stapling means for stapling a stack of sheets stacked on said stacking means at a predetermined position;

discharging means for discharging from said stacking means the sheets stapled by said stapling means; and control means for actuating said stapling means when a preset number of the sheets are stacked on said stacking means and for selectively actuating and not actuating said discharging means when the stapling operation is completed.

* * * * *

UNITED STATES PATENT AND TRADEMARK OFFICE

CERTIFICATE OF CORRECTION

PATENT NO. : 4,878,656

DATED : November 7, 1989

INVENTOR(S) : TAKESHI HONJO, ET AL.

It is certified that error appears in the above-identified patent and that said Letters Patent is hereby corrected as shown below:

COLUMN 1, line 39, "the count reaches" should be deleted;

line 40, "mined," should read --mined value is reached,--;

lines 48-49, "staple would be broken" should read --stapler could be damaged--;

line 67, "to the" should read --to staple the--.

COLUMN 2, line 6, "sheet" should read --sheets--;

line 7, "is" should read --are--;

line 15, "the" (second occurrence) should be deleted; same line, "continued to be" should read --continually--;

line 16, "on" should read --on the--.

COLUMN 3, line 38, "5," should read --5 and--;

line 42, "to" should read --to the--;

line 44, "a" should be deleted; same line, "of" should read --from--.

UNITED STATES PATENT AND TRADEMARK OFFICE

CERTIFICATE OF CORRECTION

PATENT NO. : 4,878,656

DATED : November 7, 1989

INVENTOR(S) : TAKESHI HONJO, ET AL.

It is certified that error appears in the above-identified patent and that said Letters Patent is hereby corrected as shown below:

COLUMN 4, line 6, "rollers" should read --roller--;

line 7, "rollers" should read --roller--;

line 17, "to" should read --on--;

line 34, "sheet S" should read --sheet S is provided--;

line 49, "falls" should read --fall--.

COLUMN 5, line 1, "to" should be deleted; (2nd occurrence)

line 13, "S(The" should read --S. The--;

line 67, "has" should read --as--.

COLUMN 7, line 17, "by" should be deleted;

line 30, "11" should read --S11--;

line 35, "capable" should read --staplable--;

line 66, "the" (first occurrence) should be deleted.

COLUMN 8, line 5, "causes the" should read --causes movement of the--;

line 23, "not shown" should read --(not shown)--;

line 32, "energize" should read --energizes--.

UNITED STATES PATENT AND TRADEMARK OFFICE

CERTIFICATE OF CORRECTION

PATENT NO. : 4,878,656

DATED : November 7, 1989

INVENTOR(S) : TAKESHI HONJO, ET AL.

It is certified that error appears in the above-identified patent and that said Letters Patent is hereby corrected as shown below:

COLUMN 9, line 1, "operativeness" should read --operation--;

line 10, "is" should read --may be--.

COLUMN 10, line 58, "stacking" should read --stapling--.

COLUMN 11, line 2, "bundle" should read --bundles--;

line 7, "bundle" should read --bundles--.

COLUMN 12, line 14, "sheet" should read --sheets--.

Signed and Sealed this

Twenty-fifth Day of September, 1990

*Attest:*

HARRY F. MANBECK, JR.

*Attesting Officer* *Commissioner of Patents and Trademarks*